US005195204A

United States Patent [19]

Muller et al.

[11] Patent Number: 5,195,204

[45] Date of Patent: Mar. 23, 1993

[54] CONSTRUCTION EQUIPMENT AND METHOD FOR PRECAST SEGMENTAL BRIDGES

[75] Inventors: Jean Muller, Suresnes, France; Gerard Sauvageot, Poway, Calif.

[73] Assignee: J. Muller International, San Diego, Calif.

[21] Appl. No.: 880,579

[22] Filed: May 8, 1992

Related U.S. Application Data

[63] Continuation of Ser. No. 558,828, Jul. 27, 1990.

[51] Int. Cl.[5] ..... E01D 15/12; E01D 1/00

[52] U.S. Cl. ..... 14/4.0; 14/71.1

[58] Field of Search ..... 14/1, 4, 17, 23, 71.1, 14/77; 212/190, 191; 414/267, 277-278, 137.9, 138.5, 138.8

[56] References Cited

U.S. PATENT DOCUMENTS

| | | | |
|---|---|---|---|
| 3,832,748 | 9/1974 | Ogletree | 14/77 X |
| 3,863,771 | 2/1975 | Dobbie et al. | 14/23 X |
| 3,909,863 | 10/1975 | Macrander et al. | 14/17 |
| 3,937,165 | 2/1976 | Thivans | 14/77 |
| 4,059,194 | 11/1977 | Barry | 14/278 |
| 4,480,757 | 11/1984 | Oustad | 414/137.9 X |
| 4,497,153 | 2/1985 | Müller | 14/1 X |
| 4,569,453 | 2/1986 | Oustad | 212/191 |
| 4,630,798 | 12/1986 | Müller | 14/1 X |
| 4,675,931 | 6/1987 | Quint | 14/71.1 |
| 4,762,456 | 8/1988 | Nelson | 212/190 X |

FOREIGN PATENT DOCUMENTS

| | | |
|---|---|---|
| 2704033 | 8/1978 | Fed. Rep. of Germany . |
| 1523191 | 3/1968 | France . |

OTHER PUBLICATIONS

Travaux, No. 469, Apr. 1974, Paris FR, pp. 47-48, Quiedeville, "Material Approprie Aux Conditions De Site Et De Delai: Le Cas Des Ponts De Vienne".

*Primary Examiner*—Ramon S. Britts
*Assistant Examiner*—Nancy P. Connolly
*Attorney, Agent, or Firm*—Baker, Maxham, Jester & Meador

[57] ABSTRACT

A bridge construction system includes a first independent longitudinal truss positioned over a first bridge span, a second independent longitudinal truss positioned over a second bridge span, a gantry movably mounted on said trusses, the gantry having a first leg mounted to the first truss and a second leg mounted to the second truss, the gantry being drivable along the first and second trusses, a gantry drive for controllably driving the gantry along the trusses, a transverse trolley movably mounted on the gantry, the trolley being drivable along the gantry in a direction generally transverse to the longitudinal trusses, the trolley including a winch for lifting and carrying bridge components to be positioned along the bridge spans over which the longitudinal trusses are mounted, the trolley being selectively positionable over each of the bridge spans, and supports for mounting the longitudinal trusses to bridge components disposed along each of the bridge spans.

39 Claims, 13 Drawing Sheets

FIG. 6
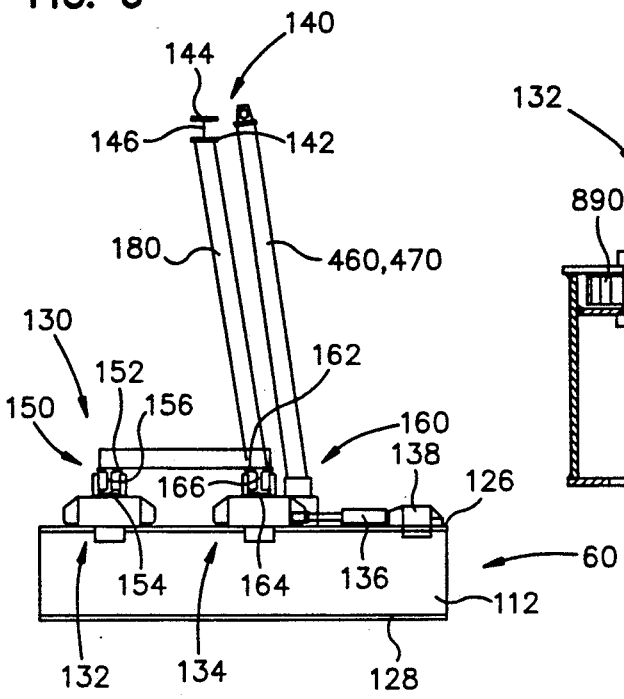
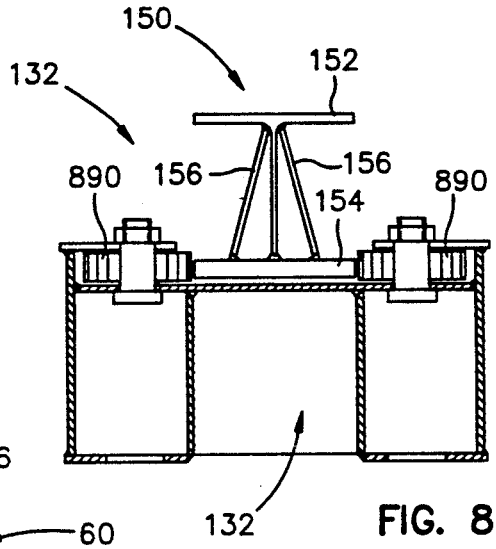
FIG. 8
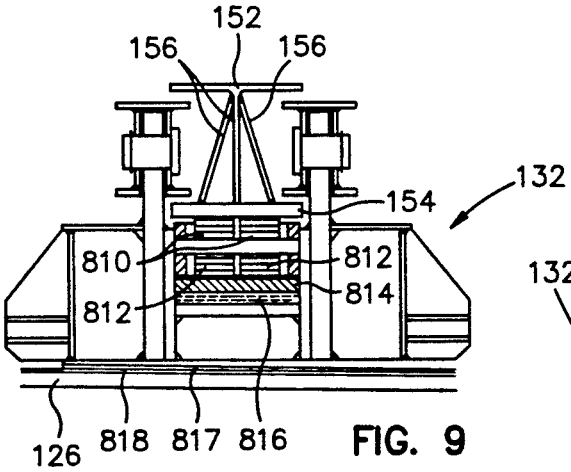
FIG. 9
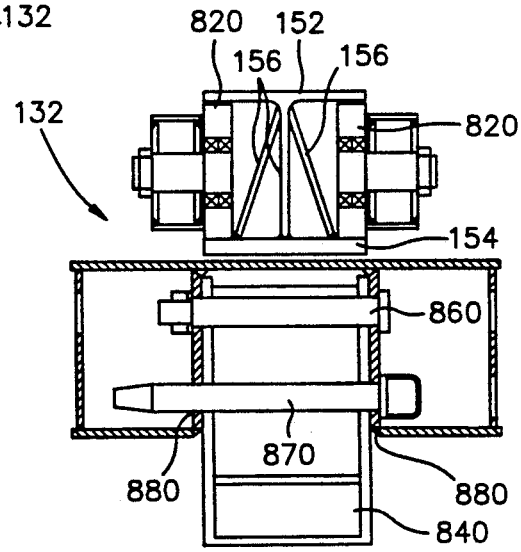
FIG. 10

CONSTRUCTION EQUIPMENT AND METHOD FOR PRECAST SEGMENTAL BRIDGES

This is a continuation (FILE WRAPPER) of application Ser. No. 07/558,828 filed July 27, 1990.

BACKGROUND OF THE INVENTION

The present invention relates to the field of bridge construction, and more particularly, the construction of precast segmental bridges, especially those having multiple bridge spans, wherein successive bridge segments are positioned and attached to existing bridge components.

Precast segmental bridges are known and commonly used throughout the world as a means to forge roadways through mountainous terrain or across rivers and other natural barriers. Such bridges are typically constructed in accordance with the following sequence: First, a series of upright piers are formed along the bridge span. Thereafter, cantilevered bridge sections are built out from each pier by successively mounting the precast segments to previously completed bridge components and post-tensioning the segments thereto. The cantilevered bridge sections are built out from each pier in a symmetrical fashion so that the piers are not subjected to undue bending loads. When the cantilever sections are complete, the ends thereof are post-tensioned together to form a continuous bridge deck. Typically, two such bridge spans are constructed to accommodate the two directions of travel. These spans run generally side-by-side, but need not be parallel (horizontally or vertically) nor at the same elevation.

Prior techniques employed in the construction of precast segmental bridges have relied on use of a single piece of equipment able to erect one deck at a time, starting from one end and finishing at the other end of the bridge. In the case where several decks were erected, the piece of equipment had to be repeatedly used, or two or more pieces of equipment were used simultaneously. Both options added significant time and expense to bridge construction.

The most frequently used techniques in the past involve the use of a launching girder resting on top of the deck under construction. Such techniques have been used, for example, at Rio-Niteroi Bridge, Brazil where four (4) launching girders (two at each end of the bridge) were used simultaneously to build two (2) parallel decks at the same elevation. Similarly, at Chillon Viaducts, Switzerland, a single launching girder was used to build two parallel decks, at different elevations, with each deck being built independently, one after the other.

SUMMARY OF THE INVENTION

It is an object of the present invention to provide a construction system for erecting precast segmental bridges wherein a minimum number of construction components are required and wherein construction time is dramatically reduced for multi-span segmental bridges.

It is a further object of the present invention to provide a construction system for simultaneously constructing multi-span segmental bridges wherein the spans are not elevationally parallel.

It is a further object of the present invention to provide a construction system for multi-span segmental bridges wherein the bridge spans are not horizontally parallel.

It is a further object of the present invention to provide a construction system for multi-span segmental bridges wherein the bridge spans are of differing elevation.

It is a further object of the present invention to provide a construction system for multi-span segmental bridges wherein the lateral spacing between the spans is varied.

The present invention is accordingly directed to a construction system for multi-span segmental bridges which may be embodied in a pair of independent trusses positioned above the outer bridge spans. The trusses to provide a path for a transverse gantry having a trolley and winch system for successively lifting and transporting bridge segments for connection on a plurality of bridge spans. In accordance with one aspect of the invention, there may be provided a first independent longitudinal truss positioned over a first bridge span, a second independent longitudinal truss positioned over a second bridge span, a gantry movably mounted on the trusses, the gantry having a first leg mounted to the first truss and a second leg mounted to the second truss, a gantry drive for controllably driving the gantry along the trusses, a transverse trolley movably mounted on the gantry, the trolley being drivable along the gantry in a direction generally transverse to the longitudinal trusses, the trolley including a winch for lifting and carrying bridge components to be positioned along at least one bridge span, the trolley being selectively positionable over each of the bridge spans, and supports for mounting the longitudinal trusses to bridge components disposed along each of the bridge spans.

DESCRIPTION OF THE DRAWING

FIG. 6 is a detailed diagrammatic view of a longitudinal truss and associated roller support assemblies of the construction system shown in FIG. 1.

FIG. 8 is a detailed cross-sectional view of the truss roller support assembly of FIG. 7 taken along line 8—8 of FIG. 7.

FIG. 9 is a detailed cross-sectional view of the truss roller support assembly of FIG. 7 taken along line 9—9 of FIG. 7.

FIG. 10 is a detailed cross-sectional view of the truss roller support assembly of FIG. 7 taken along line 10—10 of FIG. 7.

FIGS. 16*a*-1 is a sequential diagrammatic view of the launching sequence of the construction system of FIG. 1.

DESCRIPTION OF THE PREFERRED EMBODIMENTS

Figure 1:
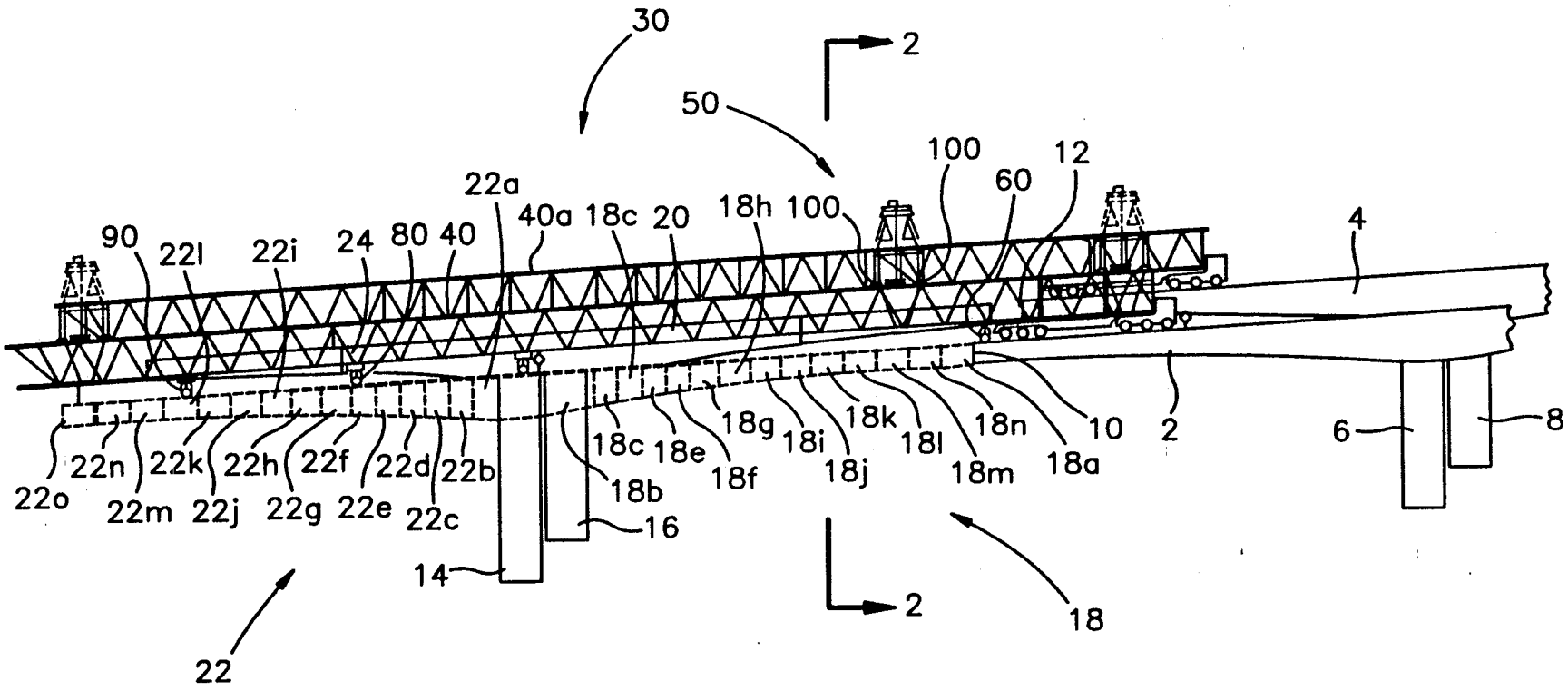
FIG. 1 is a side elevation view of a construction system in accordance with the present invention showing the positioning of the system for construction of bridge components from a first bridge pier adjacent a completed bridge span portion.

Turning to FIG. 1, a pair of generally side-by-side completed bridge sections 2 and 4 are cantilevered from bridge piers 6 and 8, respectively to terminations 10 and 12. The terminations 10 and 12 extend to the approximate center of the bridge spans defined by the piers 6 and 8 on one side, and the adjacent piers 14 and 16 on the other side of the spans, respectively. Partially completed cantilevered bridge span sections 18 and 20 extend from the piers 14 and 16, respectively, toward the end terminations 10 and 12 of the previously completed bridge sections 2 and 4. As shown, the partially complcted cantilevered bridge section 18 includes precast concrete segments 18*a*–18*h*. Shown in phantom are the positions where subsequent precast segments 18*i*–18*n* will be positioned. The remaining gap between the bridge segment 18*n* and the termination 10 of the previously completed bridge section 2 will be filled with a final precast segment 18*o*. Similar partially completed cantilevered bridge sections 22 and 24 extend from the other side of the bridge piers 14 and 16. The section 22 includes segments 22*a*–22*o* which will bring the bridge section 22 in contact with yet another bridge section or with existing roadway. The respective sections 18*a*–1-8*o*–and 22*a*–22*o* are alternatively attached to the pier 14 to provide a symmetrical section build up to avoid placing unnecessary bending loads on the pier 14. The bridge sections extending from the pier 16 are mounted in similar fashion. Each precast segment is attached to existing bridge components using well known post-tensioning techniques.

The precast segments to be affixed to the bridge sections 18 and 20, and 22 and 24, are conveniently transported and positioned for attachment using a construction system 30 now to be described. The construction system 30 includes, generally, a pair of longitudinal trusses 40 and 40*a* and a rolling gantry 50. The longitudinal truss 40 is supported at one end thereof adjacent the termination 10 of the completed bridge section 2 using a mounting support 60. The longitudinal truss 40 is supported at the approximate mid-span thereof on the pier 14 using the mounting support 70. Additional mounting supports 80 and 90 may be provided as the partially completed bridge section 22 is constructed. A similar mounting arrangement is provided for the longitudinal truss 40*a*. The rolling gantry 50 includes roller assemblies 100 and 100*a* that are rollably mounted to the top of the longitudinal trusses 40 and 40*a*, respectively. A gantry drive (to be described) provides motive power to drive the rolling gantry 50 along the longitudinal trusses 40 and 40*a*. The precast bridge segments are typically delivered to a location adjacent the completed bridge terminations 10 and 12, as shown in FIG. 1, where they are picked up by the rolling gantry 60 and transported for attachment to the partially completed bridge sections 18, 20, 22, and 24. The longitudinal range of the rolling gantry 50 is shown in phantom line representation at the ends of the trusses 40 and 40*a*.

Figure 2:
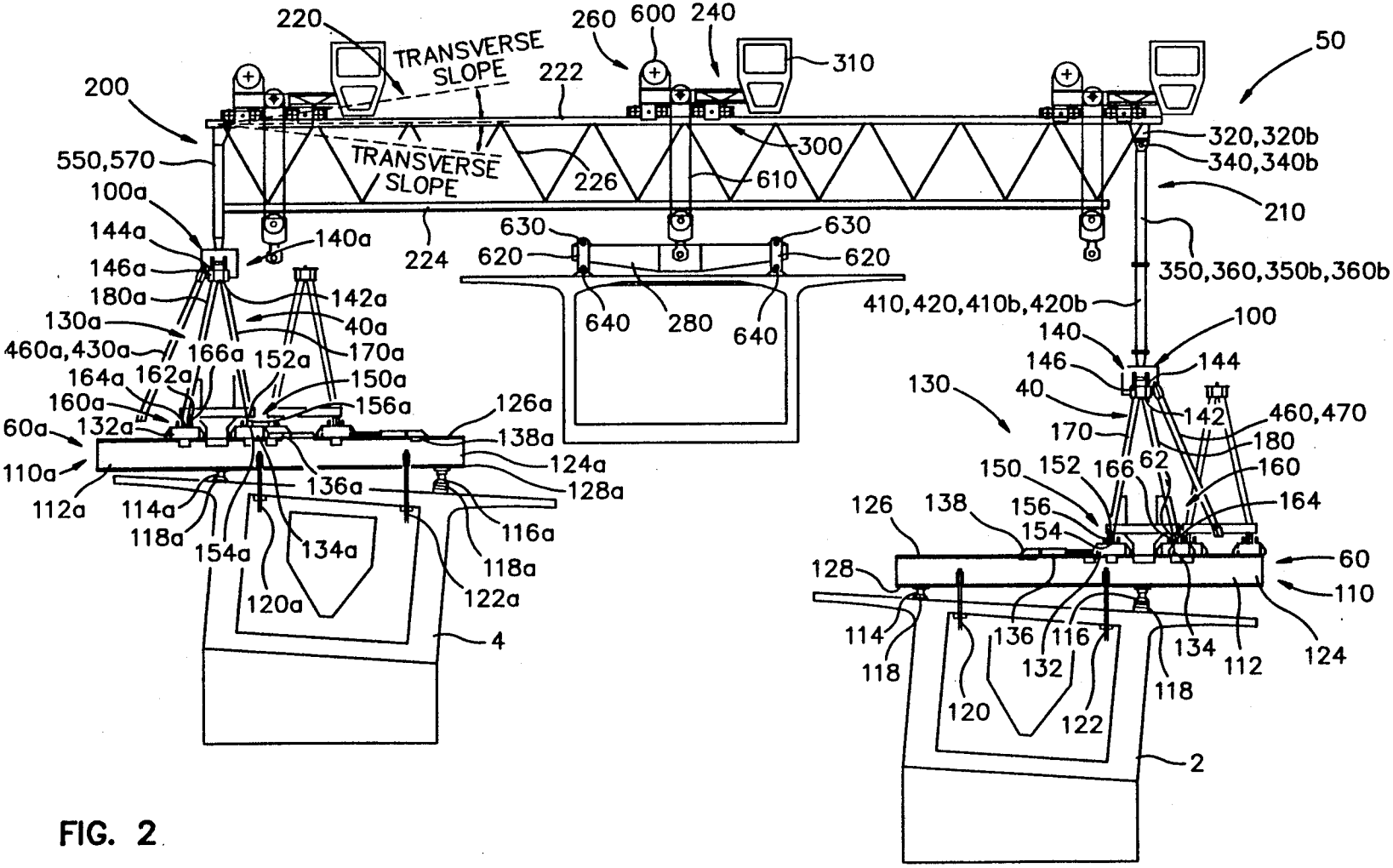
FIG. 2 is a cross-sectional view taken along line 2—2 in FIG. 1 showing the construction equipment of FIG. 1 transporting a bridge segment for connection to a bridge span section.

Referring now to FIG. 2, the longitudinal trusses 40 and 40*a* are mounted, respectively, on the support assembly 60 and its adjacent bridge span counterpart 60*a*. The support assemblies 60 and 60*a* include corresponding transverse beam assemblies 110 and 110*a*. The beam assemblies 110 and 110*a* include a transverse steel beam section 112 and 112*a* supported on the completed bridge sections 2 and 4, respectively, using hydraulic jacks 114 and 116, and 114*a* and 116*a*, which are mounted to the bottom of the transverse beam sections 112 and 112*a*, respectively. In addition, one or more shims 118 and 118*a* may be used to adjust the height of the beams sections. The transverse beam section 112 and 112*a* are secured to the bridge sections 2 and 4 using steel tie-downs 120 and 122, and 120*a* and 122*a*, respectively. The transverse beam sections 112, 112*a* may be of conventional double I-beam construction having a pair of webs 124, 124*a* and upper and lower flanges 126, 126*a* and 128, 128*a*, respectively.

The support assemblies 60 and 60*a* further include roller assemblies 130 and 130*a*, respectively. The roller assembly 130 includes a pair of roller units 132 and 134, while the roller assembly 130*a* includes roller units 132*a* and 134*a*. The support assemblies 60 and 60*a* further include a jack 136 and 136*a* for transversely positioning the roller units 132, 134 and 132*a*, 134*a*, respectively, with respect to the transverse beam sections 112 and 112*a*. The transverse jacks 136 and 136*a* are mounted to the upper flange 126 and 126*a* of the transverse beam sections 112 and 112*a* using lock downs 138 and 138*a*, respectively. As shown in phantam, the roller units 132 and 134 can be transversely repositioned by activating the hydraulic jack 136. The same holds true for the roller units 132*a* and 134*a*, except that the hydraulic jack 136*a* is used. As discussed below, such transverse positioning is used to pivot the longitudinal trusses 40 and 40*a* in order to accommodate horizontal bridge span curvature.

Figure 12:
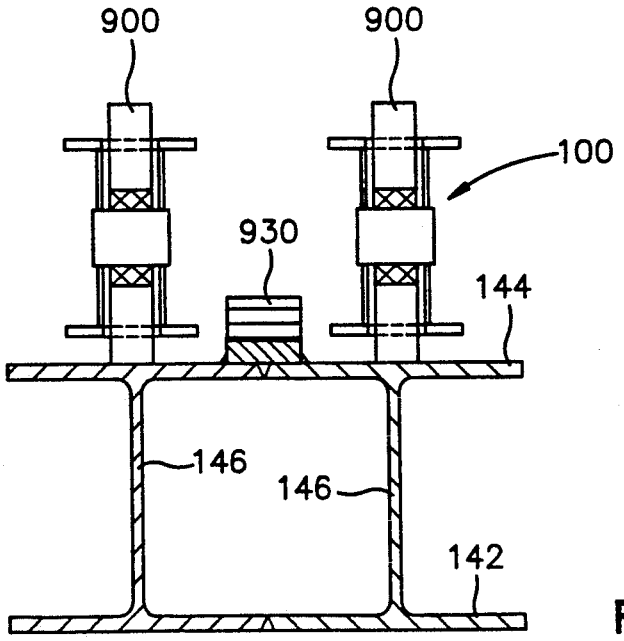
FIG. 12 is a detailed cross-sectional view of the gantry support roller assembly of FIG. 11 taken along line 12—12 of FIG. 11.

Still referring to FIG. 2, the horizontal truss 40 is configured in a general three-sided arrangement that includes an upper compression flange 140 that itself includes lower and upper flanges 142 and 144, respectively and a plurality of intermediate webs 146, shown in more detail in FIG. 12. As further described below, the upper flange 144 provides a roller bearing surface for the gantry 50. The longitudinal truss 40 further includes a pair of lower tension flanges. The first lower flange, 150, itself includes an upper flange 152, a lower flange 154 and intermediate web members 156, shown in more detail in FIG. 9. As discussed hereinafter, the lower flange 154 provides a lower bearing surface for the longitudinal truss 40. The longitudinal truss 40 further includes a second lower flange section 160 which itself includes an upper flange 162, a lower flange 164 and intermediate web members 166. Like the lower flange 154, the flange 164 also provides a lower bearing surface for the horizontal truss 40. The horizontal truss 40*a* is of similar construction and includes similar components 140*a*–166*a* whose arrangement and function are the same as the corresponding components 140–160 of the horizontal truss 40. The horizontal trusses 40 and 40*a* further include leg elements 170 and 180, and 170*a* and 180*a*, respectively.

Still referring to FIG. 2, the rolling gantry 50 is rollably mounted on the horizontal trusses 40 and 40*a* on the roller assemblies 100 (described in detail hereinafter). The gantry 50 further includes a fixed leg assembly 200 and a pendulum leg assembly 210, both of which are joined by ball joint connections to the roller assemblies 100. The rolling gantry 50 further includes a transverse truss assembly 220 that is generally fixedly connected at one end to the fixed leg 200 and is pivotally connected through a ball joint connection at its other end to the pendulum leg 210. Rollably mounted on the transverse truss assembly 220 is a lifting trolley assembly 240 that includes a winch assembly 260, a spreader beam 280 for carrying precast segments and a roller assembly 300 which is rollably mounted on the upper portion of the transverse truss assembly 220. The lifting trolley assembly further includes a traveling crane 310 and a power drive (not shown) providing motive power to drive the lifting trolley assembly 240 along its transverse drive path. The range of positions of the lifting trolley assembly 240 is shown in phantom line representation at the ends of the truss assembly 220.

Figure 3:
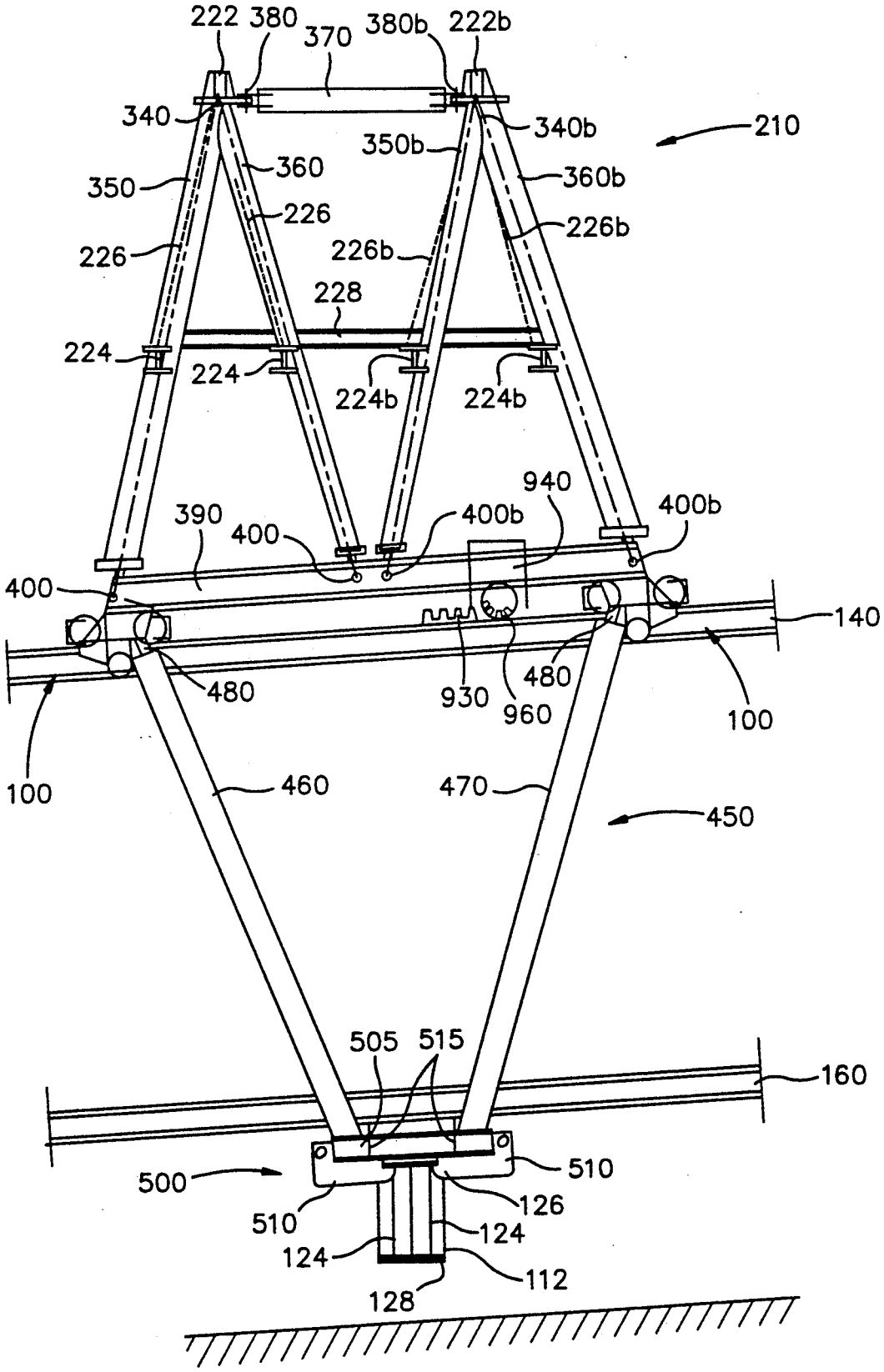
FIG. 3 is a side-elevational view of a pendulum leg portion of the construction system of FIG. 1.
Figure 3A:
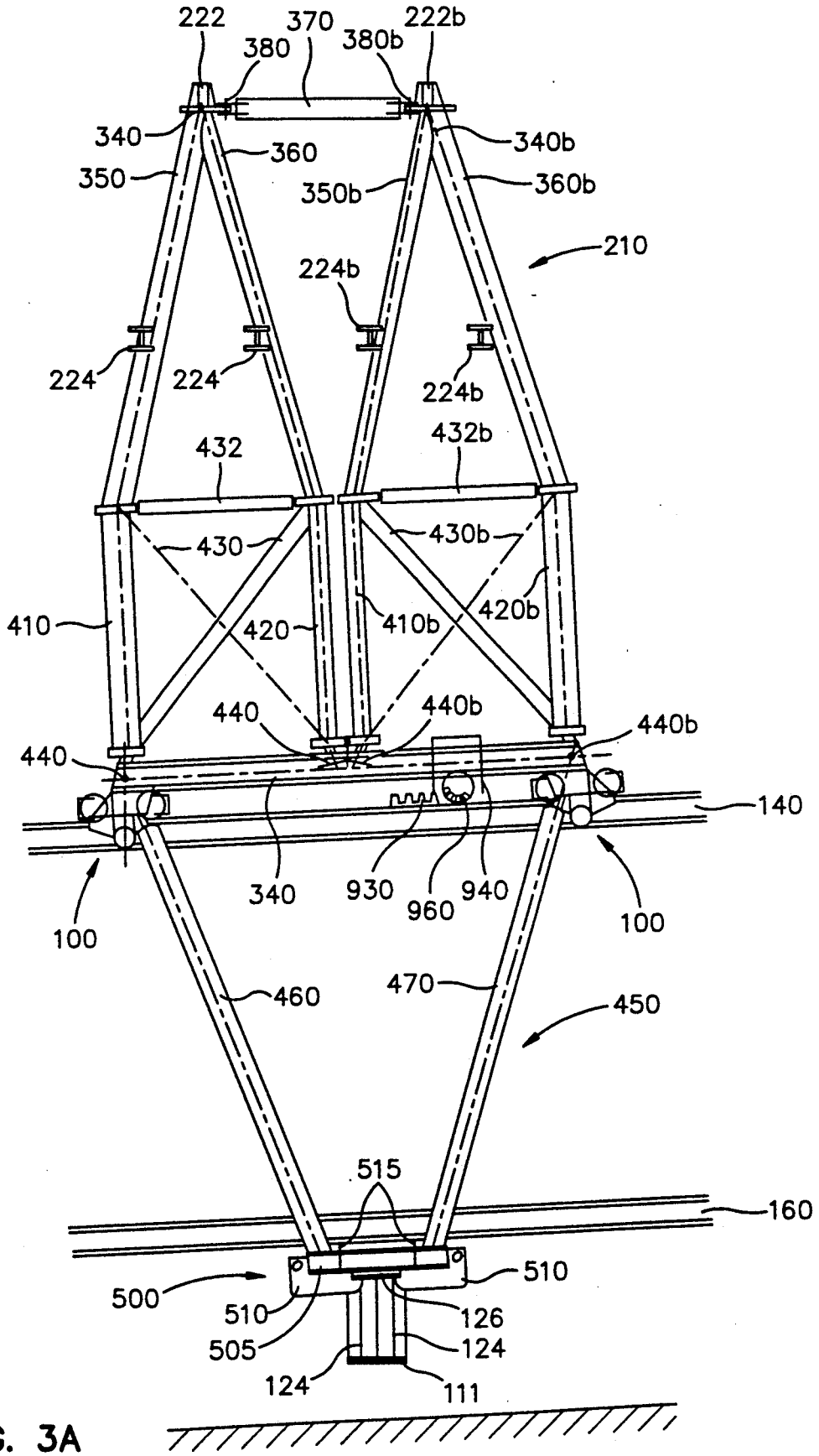
FIG. 3*a* is a side-elevational view of an alternative pendulum leg portion of the construction system of FIG. 1.

Referring now to FIGS. 3 and 3*a*, the pendulum leg assembly 210 of the rolling gantry 50 is shown in greater detail. As shown therein, the transverse truss assembly 220 of the rolling gantry 50 includes a pair of transverse trusses having a single upper flange 222 and 222*b*, respectively. Each of the flanges 222 and 222*b* includes upper and lower flanges and intermediate web sections, with the upper flange providing an upper roller bearing surface for the roller assembly 300 of the lifting trolley 240. The individual trusses of the transverse truss assembly 220, further include a pair of lower flanges 224 and 224*b*, each having respective upper and lower flanges and an intermediate web section. The upper and lower flanges 222 and 224, and the upper and lower flanges 222*b* and 224*b* are joined by a series of intermediate truss members 226 and 226*b*, respectively. Moreover, each of the bottom flanges 224, 224, and 224*a*, 224*a* are joined by a longitudinally extending stabilizing beam 228.

Figure 3B:
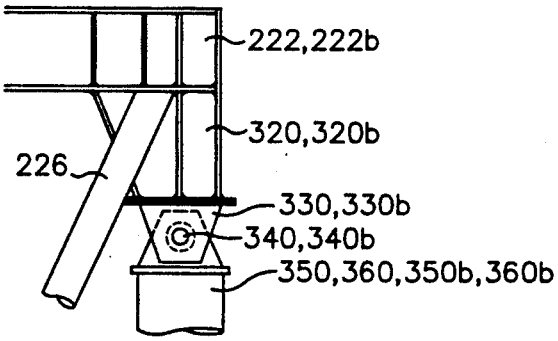
FIG. 3*b* is a detailed side view of a pivotal connection in the pendulum leg portion of the construction system of FIG. 1.

As shown in FIG. 3*b*, the upper flanges 222, 222*b* of the transverse truss assembly 220 include at the ends thereof lower extensions 320, 320*b*, having attached thereto lugs 330, 330*b*. The lugs 330, 330*b* are joined by ball joint connections 340, 340*b* to the legs of the pendulum leg assembly 210. Thus, the ball joint 340 pivotally connects the lug 330 to the pendulum legs 350 and 360. Similarly, the ball joint 340*a* pivotally joins the lug 330*a* to the legs 350*a* and 360*a*. The ball joint connections 340 and 340*a* themselves are pivotally connected to a stabilizing member 370 through ball joint connections 380 and 380*b*, as shown in FIG. 3. Thus, the pendulum leg assembly 210 is free to pivot about a generally longitudinal axis as well as twist about a transverse axis and a vertical axis, independently of the transverse truss assembly 220.

Still referring to FIG. 3, the pendulum legs 350 and 360 extend downwardly to a longitudinal stabilizing member 390 and are joined thereto with ball joint connections 400. Similarly, the pendulum legs 350*b* and 360*b* extend downwardly to the longitudinal stabilizing member 390 and are connected thereto through ball joint connections 400*b*. The longitudinal stabilizing member 390 is in turn fixedly mounted to the gantry roller assemblies 100.

Referring now to FIG. 3*a*, the pendulum leg assembly 210 is shown with a leg extension added thereto to accommodate changes in elevation differential between the longitudinal trusses 40 and 40*a*. Thus, the pendulum legs 350 and 360 extend to and are fixedly connected to vertical leg extension members 410 and 420. Similarly, the pendulum leg members 350*b* and 360*b* extend to and are fixedly connected to the vertical leg extension members 410 and 420*a*. The legs 410, 420 and 410*b*, 420*b* are stabilized by diagonal stabilizing members 430 and 430*b*, and horizontally stabilizing members 432 and 432*b*, respectively. The vertical leg extension members 410 and 420 are pivotally connected to the longitudinal stabilizing member 390 with ball joint connections 440. Similarly, the vertical leg extension member 410*a* and 420*b* are pivotally connected to the longitudinal stabilizing member 390 with ball joint connections 440*b*.

Referring now to FIGS. 2 and 3, the gantry roller assemblies 100 have pivotally connected thereto a launching frame assembly 450 which is used to connect the rolling gantry 50 to a truss support assembly 60 such that the gantry drive system can be used to longitudinally translate the trusses 40 and 40*a* while the rolling gantry 50 remains fixedly positioned, as discussed in greater detail below. The launching frame assembly 450 includes a pair of launching frame legs 460 and 470 joined to respective roller assemblies 100 through ball joint connections 480. The launching frame legs 460 and 470 are connected at their lower extremity to a lock down assembly 500. The lockdown assembly 500 includes a longitudinal support member 505 to which the launching frame legs 460 and 470 are fixedly connected. Pivotally mounted to the ends of the longitudinal support member 505 are a pair of pivoting lock members 510 that are pivotable from an unlocked position to a locked position wherein the lock members 510 engage the upper flange 126 of the transverse truss support beam 112. The lock members are secured thereto with a pair of pin members 515 such as bolts or the like, extending through the lock members and the longitudinal support member 505. In the unlocked position, the launching frame assembly 450 may be pivoted up and away from the transverse support beam 112 to facilitate unrestricted gantry movement.

Figure 4:
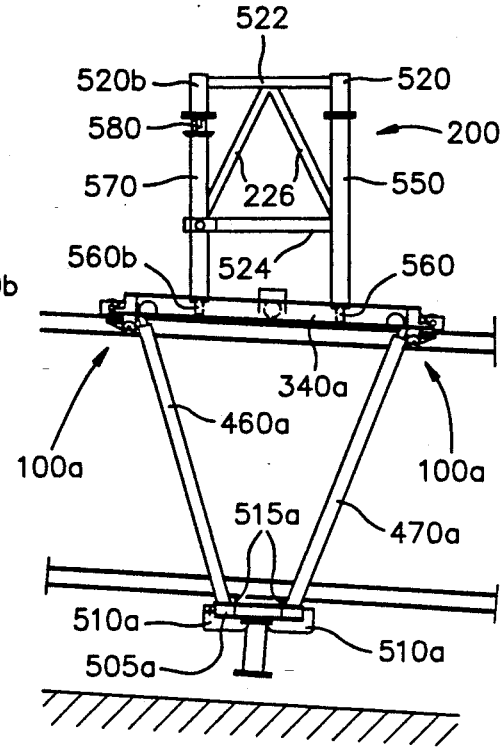
FIG. 4 is a side-elevational view of a side-elevational view of a fixed leg portion of the construction system of FIG. 1.
Figure 4A:
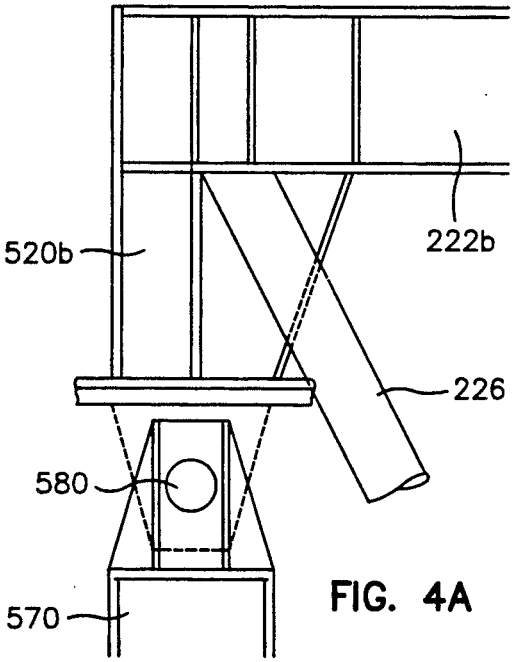
FIG. 4*a* is a detailed side view of a pivotal connection in the fixed leg portion of the construction system of FIG. 1.
Figure 4B:
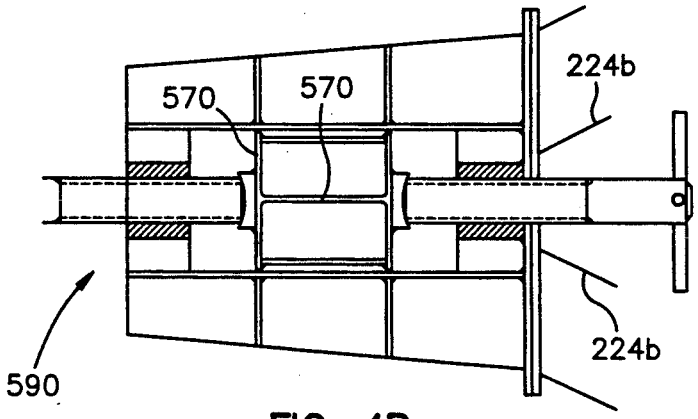
FIG. 4*b* is a detailed plan view of a transverse beam positioning connection in the fixed leg portion of the construction system of FIG. 1.

Referring now to FIG. 4, the fixed leg assembly 200 of the rolling gantry 50 is shown. At the fixed leg end of the rolling gantry transverse truss assembly 220, the upper flanges 222 and 222*a* include shoulders 520 and 520*b*, respectively, at the ends thereof. Horizontal stabilizing members 522 and 524 extend between the shoulders 520 and 520*b*, and fixed legs 550 and 570, respectively. The fixed leg 550 is fixedly connected at one end to the shoulder 520 and is pivotally connected at its other end to a longitudinal stabilizing beam 390*a* extending between a pair of gantry roller assemblies 100*a*. The pivotal attachment between the fixed leg 550 and the stabilizing beam 390*a* is provided by a ball joint connection 560. The shoulder 520*b* extending from the transverse truss flange 222*b* is pivotally connected to the second fixed leg 570 through a pin connection 580, shown in greater detail in FIG. 4*a*. The fixed leg 570 is pivotally attached at its other end to the longitudinal stabilizing beam 390*a* through a ball joint connection 560*b*. As further shown in FIG. 4*b*, the fixed leg 570 is connected to the lower flange member 224*b* of the gantry flange assembly 220, and the stabilizing members 524, through a jack assembly 590 to provide for transverse position adjustment of the fixed leg 570 with respect to the rolling gantry transverse truss assembly 220. This connection accommodates twisting movement of the fixed leg assembly 220 due to pivoting of the longitudinal truss 40*a* during launching. Thus, during truss launching, the jack assembly 590 is loosened to allow the fixed leg 570 to freely pivot about the pivotal connection 580. The jack assembly 590 is retightened when the longitudinal truss launching sequence is complete.

Figure 5A:
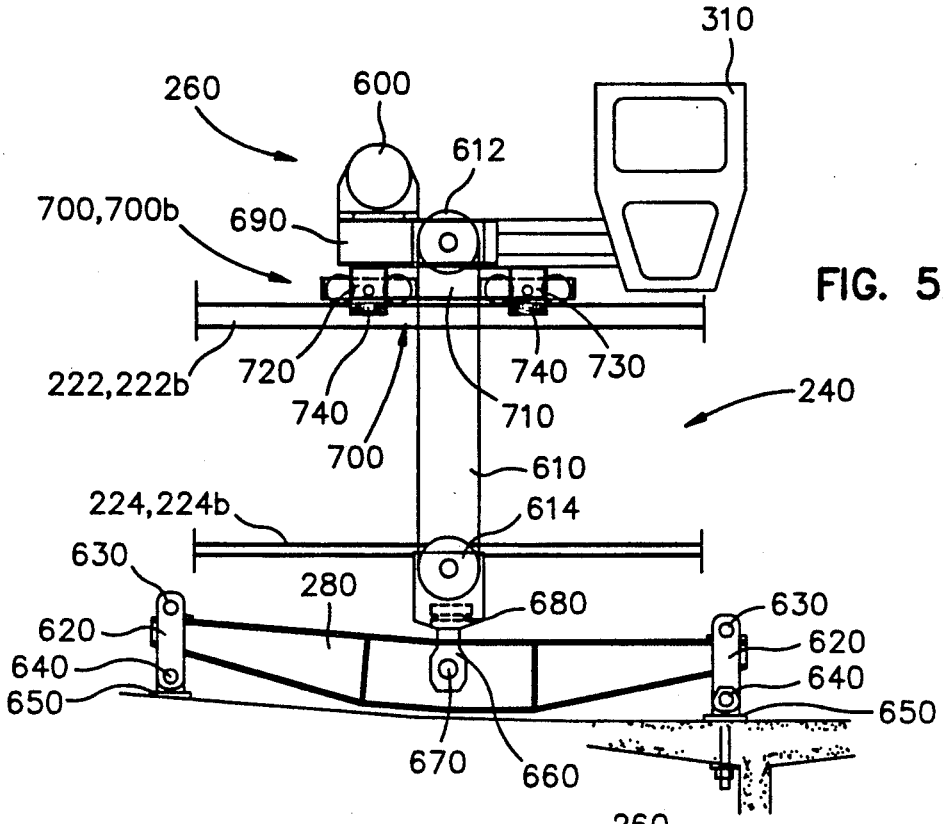
FIG. 5*a* is a detailed front-elevational view of a lifting trolley portion of the construction system of FIG. 1.
Figure 5:
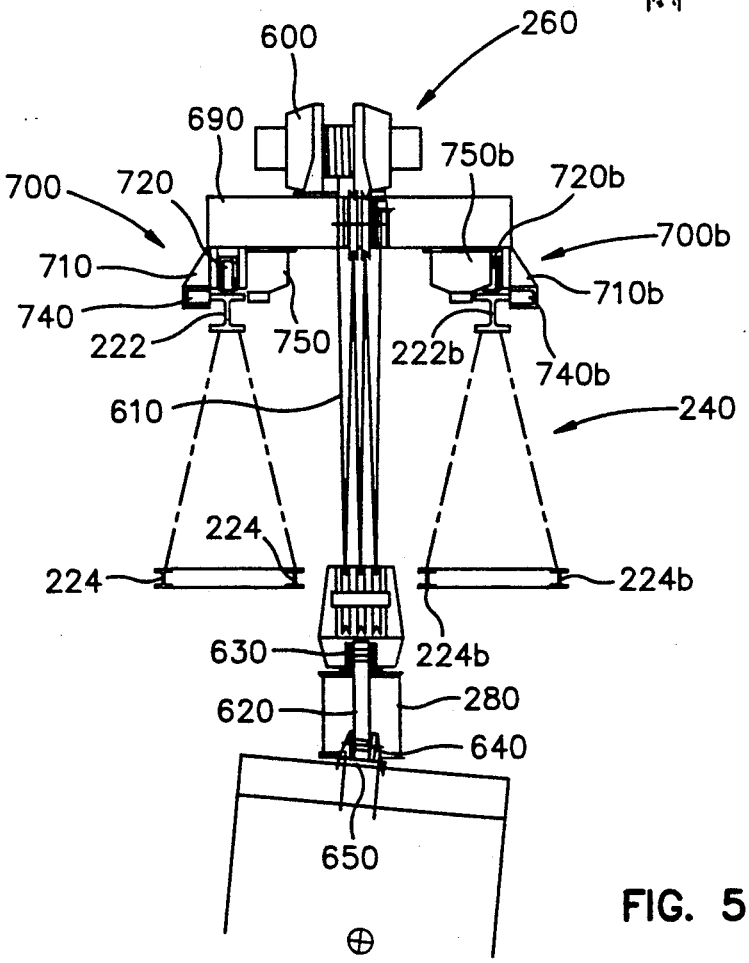
FIG. 5 is a detailed side-elevational view of a lifting trolley portion of the construction system of FIG. 1.

Referring now to FIGS. 5 and 5*a*, the lifting trolley assembly 240 is shown in greater detail. Thus, the winch assembly 260 includes a power winch drive 600 and a block and tackle system 610. The block and tackle system includes upper and lower blocks 612 and 614, respectively. A precast segment to be transported for attachment to a bridge under construction is pivotally connected to the spreader beam 280 using a pair of link members 620. The links 620 are pivotally connected to the top of the spreader beam with a pin connection 630. The link members 620 are pivotally connected to the top of a precast segment with a ball joint connection 640 and an associated mounting lug 650.

As shown in FIG. 5*a*, the spreader beam 280 is pivotally connected to the lower block 614 of the block and tackle systems 610 through the intermediary of a connecting link 660. The connecting link 660 is pivotally connected to the spreader beam 280 through a pin connection 670 arranged in a slot (not shown) in the spreader beam 280 to provide for transverse adjustment of the spreader beam. The link 660 is mounted to the lower block 614 of the block and tackle system 610 through a bearing assembly 680 that permits rotation of the link 660 with respect to the block. Thus, the precast segment can be manipulated in a plurality of positions for alignment with and placement on previously constructed bridge components.

Still referring to FIGS. 5 and 5*a*, the winch drive 600, which may be a hydraulic planetary winch as conventionally known, is mounted on a longitudinally extending support beam 690 which is attached to a pair of roller units 700 and 700*b*, respectively of the roller assembly 300. The roller units 700 and 700*b* each include a pair of support beams 710 and 710*b*, respectively, the roller units 700 further include two roller pairs 720 and 730 mounted between the roller units support beam 710. Similarly, the roller unit 700*b* includes roller pairs 720*b* and 730*b* mounted to the roller unit support beam 710*b*. The roller unit 700 is further provided with a pair of transverse rollers 740 that engage the side of the transverse truss flange 222. Similarly, the roller unit 700*b* includes a pair of transverse rollers 740*b* that engage the side of the transverse truss flange 222*b*. The roller pairs 720 and 730 of the roller unit 700 engage the top of the transverse truss flange 222. Similarly, the roller pairs 720*b* and 730*b* engage the top of the transverse truss flange 222*b*. The roller units 700, 700*b* are powered for transverse movement along the transverse truss flanges 222, 222*b* through translation power units 750, 750*a*, as shown in FIG. 5. Operation of the lifting trolley assembly 240 is directed by a human operator from the traveling crane cab 310.

Referring now to FIGS. 6–10, the details of the longitudinal truss support assembly 60 will now be described. It is understood that the following discussion pertaining to the longitudinal truss 40 applies with equal force to the longitudinal truss 40*a*, unless otherwise indicated, since the respective components of each assembly are virtually the same. Referring now to FIG. 6, the lower flanges 150 and 160 of the longitudinal truss 40 are rollably mounted for longitudinal translation on the roller units 132 and 134 of the truss support assembly 60.

Figure 7:
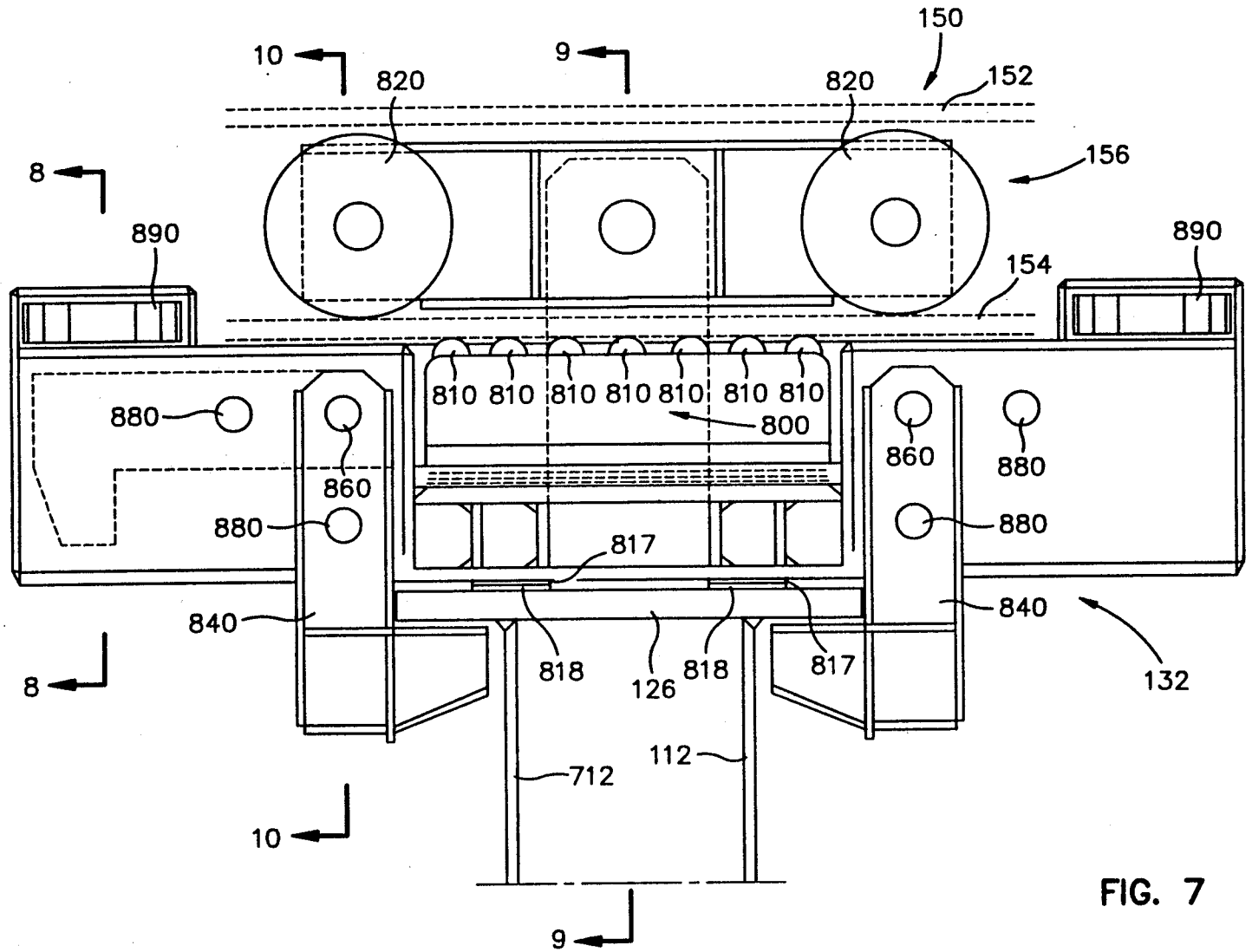
FIG. 7 is a detailed side-elevational view of a truss roller support assembly of the construction system of FIG. 1.

Referring now to FIG. 7, the roller unit 132 and lower truss flange 150 are shown in detailed side-elevation, it being understood that the components of the roller unit 134 and the lower truss flange 160 are the same. The roller unit 132 includes a central roller assembly 800 having a longitudinal row of transversely extending pin rollers 810 mounted thereon. The pin rollers 810 provide elevational support for the lower roller bearing surface 154 of the lower truss flange 150, which is supported directly thereon.

Referring now to FIG. 9, it will be observed that the rollers 810 are free-floating on underlying rollers 812 which are in turn supported on a steel support member 814. The support member 814 is mounted on a neoprene pad 816 to provide a shock absorbing support medium for the longitudinal truss 40. It will further be observed that the roller unit 132 is supported on a thin sheet of polytetrafluoroethylene (TFE) material 817 and a thin sheet of stainless steel 818 disposed over the upper flange 126 of the transverse beam 112. This enables the roller unit 132 to be easily transversely repositioned on the transverse support beam 112.

The roller unit 132 further includes two pairs of guide rollers 820 (see FIG. 10). The guide rollers 820 positively engage the top of the lower flange 154 of the truss flange 150 in order to positively restrain the truss 40 against lifting forces such that the truss 40 remains in contact with the support assembly 60 at all relevant times. In this regard, and referring now to FIGS. 7 and 10, it will be observed that the roller unit 160 is affirmatively locked in place on the transverse support beam 112 with a pair of pivotable locking arms 840 that engage the lower surface of the upper flange 126 of the transverse beam 112. The locking arms 840 are pivotally connected to the roller unit 132 with pin connections 860. The locking arms 840 may be secured in a locked position and in an unlocked position with a locking pin 870 disposed in an appropriate one of the locking apertures 880 in the roller unit 132. As shown in FIGS. 7 and 8, the roller unit 132 further includes opposing pairs of transverse rollers 890 that positively engage the sides of the lower flange 154 of the truss flange 150 so as to affirmatively restrain the truss 40 against transverse movement.

Figure 11:
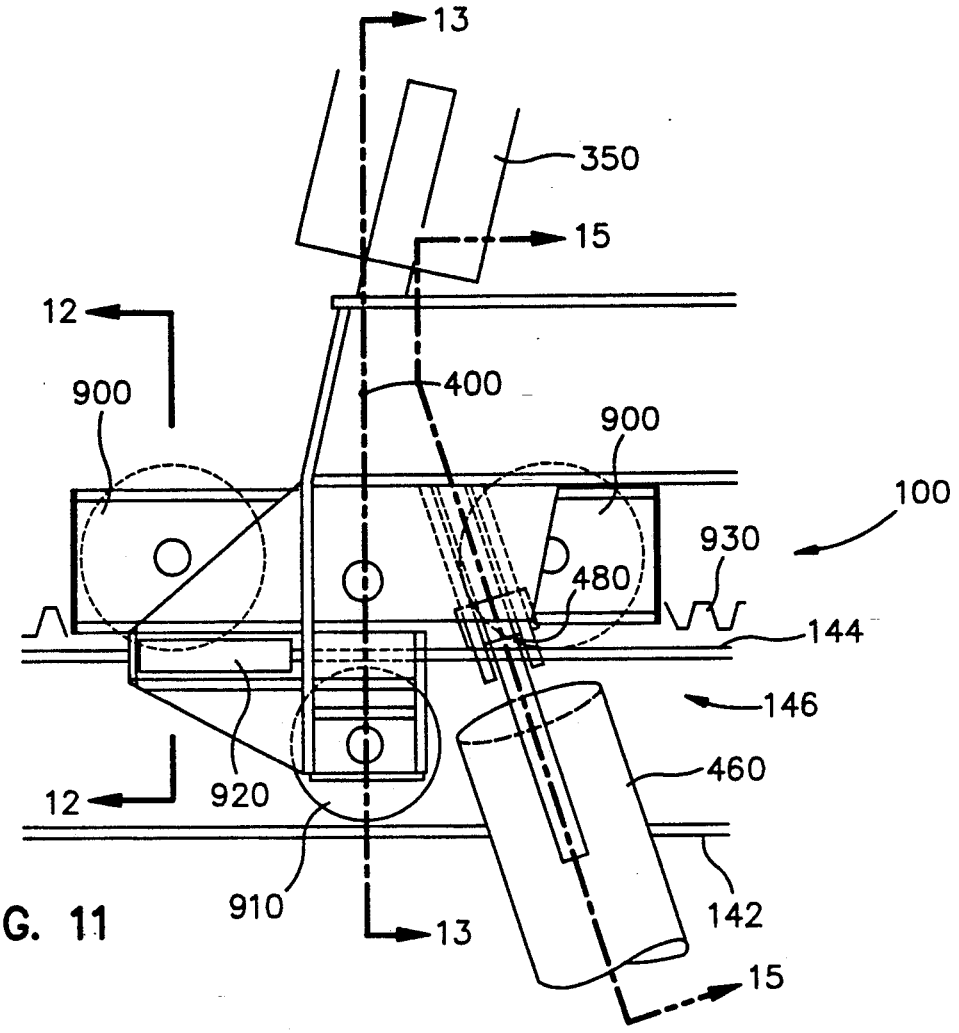
FIG. 11 is a detailed side-elevational view of a gantry roller support assembly of the construction system of FIG. 1.
Figure 13:
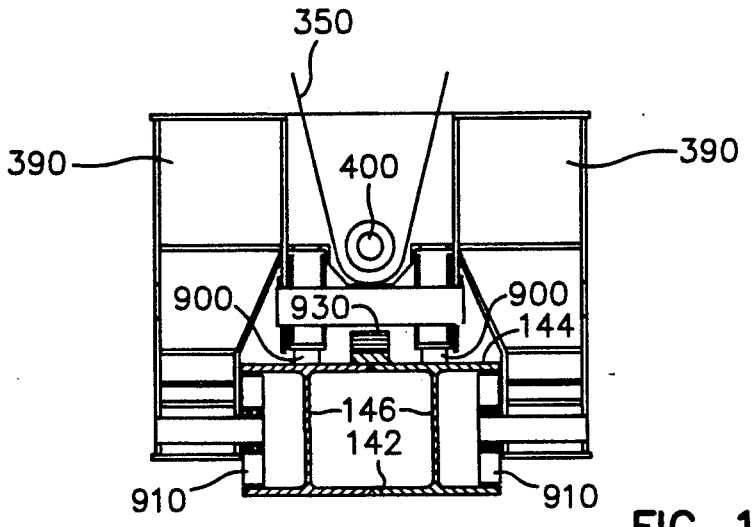
FIG. 13 is a detailed cross-sectional view of the gantry support roller assembly of FIG. 11 taken along line 13—13 of FIG. 11.
Figure 14:
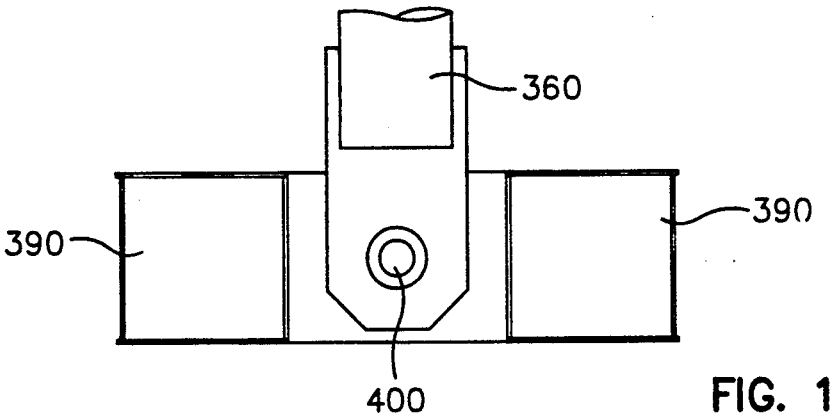
FIG. 14 is a detailed cross-sectional view through the longitudinal stabilizing member shown in FIGS. 3 and 3*a*.
Figure 15:
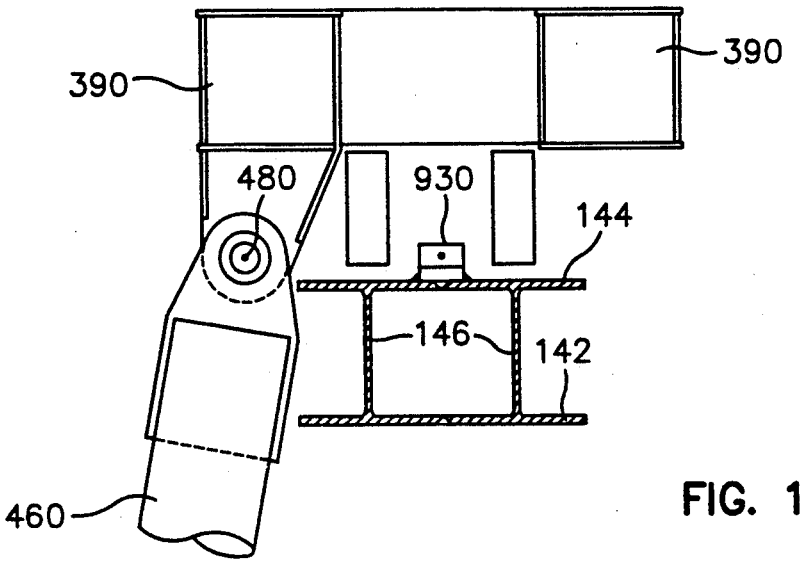
FIG. 15 is a detailed cross-sectional view of the gantry support roller assembly of FIG. 11 taken along line 15—15 in FIG. 11.

Referring now to FIGS. 11–15, the gantry roller assemblies 100 will now be described. In this regard, it is understood that only the roller unit associated with the longitudinal truss 40 is referenced since the roller unit associated with the longitudinal truss **40*a* is of substantially identical construction. The roller unit 100 includes opposing pairs of rollers 900 that positively and rollably engage the upper bearing surface 144 of the upper longitudinal truss flange 140. The roller unit 100 further includes a pair of lower tension wheels disposed between the upper and lower flanges 144 and 142, respectively, of the longitudinal truss flange 140. The tension wheels 910 prevent the roller unit 100 from becoming detached from the horizontal truss flange 140. The roller unit 100 further includes opposing pairs of guide wheels 920 that engage the sides of the upper flange 144 of the horizontal truss flange 140 to laterally restrain the rolling 100 thereon. The upper flange 144 of the horizontal truss flange 140 further has mounted thereon a longitudinally extending rack 930. As shown in FIG. 3, the longitudinal stabilizing member 390 has mounted thereon a translation drive unit 940, having a pinion gear 960 meshingly engaged with the rack 930. The translation drive unit 940 powers the roller units 100, and hence the rolling gantry 40 for longitudinal travel along the longitudinal truss. As shown in FIGS. 11, 13 and 15, the pivoting leg 350 and its associated ball joint connection 400, as well as the launching leg 460 and its associated ball joint connection 480, mount to the roller unit 100. FIG. 14 shows the pivotal connection 400 of the pivotal leg 360 to the longitudinal stabilizing member 390**.

Referring now to FIGS. **16*a*–16*e*, the operation and launching of the above-described construction system will now be described, it being understood that the following discussion of longitudinal truss 40 applies also to longitudinal truss 40*a*. The truss 40 has rollably attached thereto three support assemblies 60, 70 and 80. The truss 40 initially rests on two transverse truss support assemblies 60 and 70. The rearward support assembly 60 is mounted to a previously constructed bridge section or existing roadway, and the intermediate support assembly 70 is mounted on the pier of the bridge cantilever to be erected. If the pier segment is cast in place, the support assembly 70 rests directly on the pier segment itself. If the pier segment is a precast unit, the support assembly 70 rests on a temporary frame (not shown). The support assemblies 60 and 70 conveniently position the longitudinal truss 40 above the bridge deck so that the truss does not interfere with the placement of individual segments. As previously indicated, the support assemblies 60 and 70 provide a positive vertical connection between the concrete deck and the longitudinal truss 40 for compression and direct bearing and tension by the intermediary of the rollers. The intermediate support assembly 70 located on the pier from which the next bridge cantilever is to be constructed also includes a locking system (not shown) to provide longitudinal stability of the truss 40 against longitudinal horizontal forces. The locking system could conveniently include restraining pins extending through the lower flanges 156 and 166 of the beams 150 and 156, or other restraining apparatus. The support assemblies 60 and 70 further provide for transverse positioning of the longitudinal trusses 40 and 40*a*** to accommodate bridge span curvature and possible variations in distance between the bridge spans.

During bridge construction, the precast bridge segments are typically trucked to the end of the previously completed cantilever, where they are picked up by the lifting trolley 240 on the rolling gantry crane 50. It would also be possible to pick up the bridge segments from other locations on the ground or water over which the bridge span extends. The rolling gantry crane 50 delivers the precast segment to the end of the cantilever under construction where the segment is positioned and post-tensioned to the structure.

Starting from the pier 14, the segments are placed to extend symmetrically therefrom. As shown in FIGS. **16*b* through 16*e*, after a certain number of paired segments are placed, the forward support assembly 80 is progressively positioned toward the forward end of the truss 40 to effectively reduce the cantilever length of the truss and allow the gantry 50** to carry segments to the end of the concrete deck cantilever without relying on stay cables as is conventionally done.

Figure 16A:
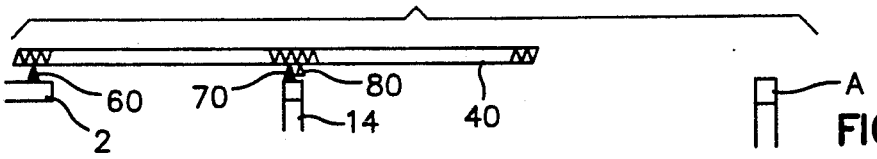
Figure 16B:
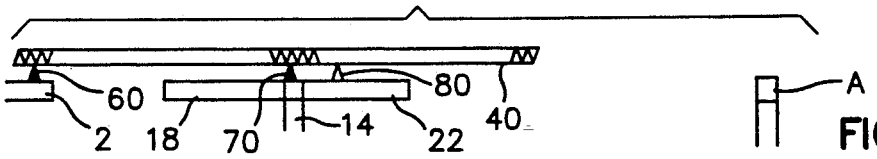
Figure 16C:
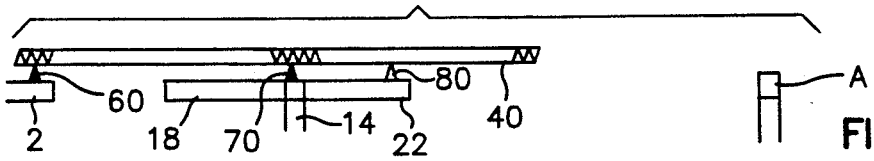
Figure 16D:
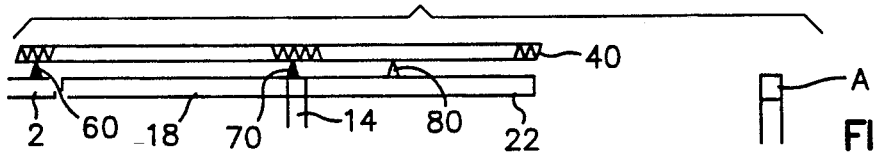
Figure 16E:
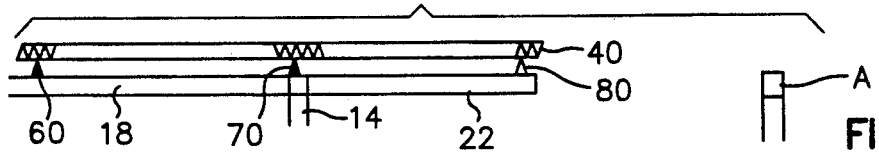
Figure 16F:
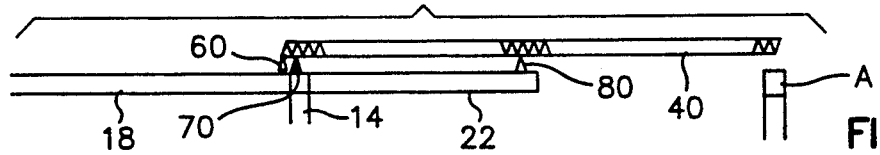
Figure 16G:
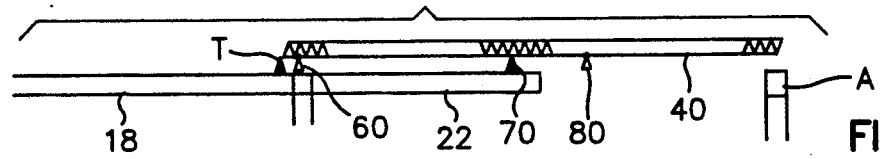
Figure 16H:
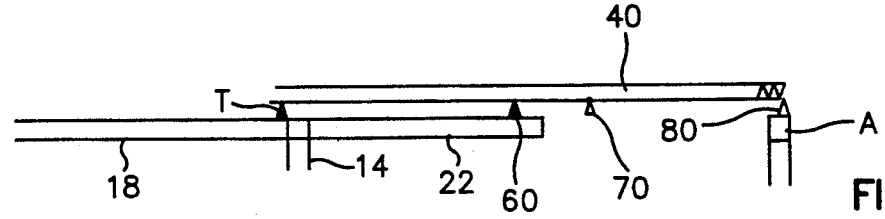

The launching of each truss is done in two (2) steps. First, after the back span 18 has been closed and the continuity post-tensioning tendon stressed, the support assembly 80 is mounted at the end of the cantilever as shown in FIG. **16*e*. The rolling gantry 50, which provides the longitudinal force to move the truss 40 through its own moving mechanism, is tied down on the center support assembly 70 and acts as a fixed drive point. The support member 60 is loosened from the bridge deck. The longitudinal truss 40 is then longitudinally translated until its front-end reaches the pier "A" as shown in FIG. 16*f*. The second longitudinal truss 40*a*** is thereafter moved in the same way.

Following the first launching step, the support assembly 70 is moved to the end of the cantilever 22. A temporary support "T," see FIG. **16*g*, is then tied to the bridge deck behind the support assembly 660 at the pier 70. The support assembly 80 is moved to and installed on the pier "A." The support assembly 60 is then moved to and mounted on to the end of the cantilever 22, while the support assembly 70 as well as the temporary support T, are detached from the bridge deck, as shown in FIG. 16***h*. The rolling gantry crane 50 is then moved and tied down to the support assembly 80 located at the Pier "A."

Figure 16I:
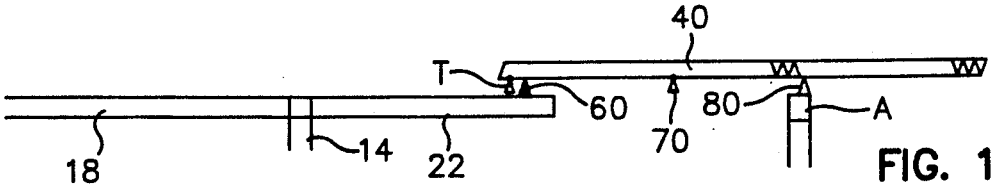
Figure 16J:
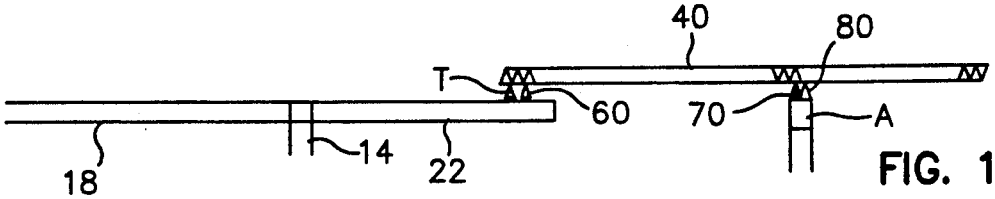
Figure 16K:
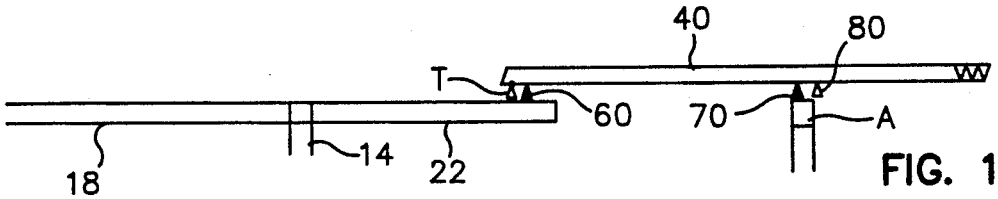
Figure 16L:
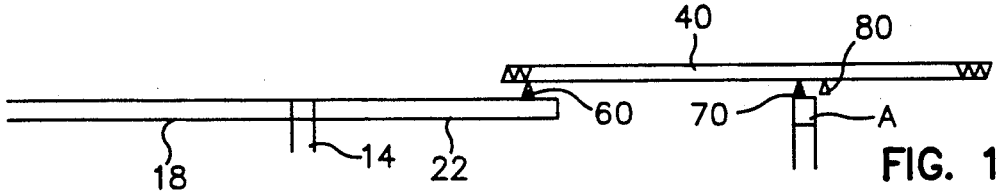

As shown in FIG. 16*i*, the longitudinal truss 40 is launched forward again until its approximate center reaches the support assembly 80 on the pier "A," from which new bridge cantilever construction is to commence. The second longitudinal truss 40*a* is moved in the same way. The support assembly 70 is then moved to and attached to the pier "A," the support assembly 80 is released therefrom, and the temporary support T is removed from the truss 40. Othering launching sequences would also be possible in accordance with the teachings herein.

Referring now to FIGS. 17–19*b*, the procedure for launching under conditions where the bridge span has horizontal curvature is shown. When the bridge span has a horizontal curvature, the trusses 40 and 40*a* must be transversely repositioned during launching to follow the bridge center line. This is done on a support assembly which is away from the rolling gantry crane 50. Thus, at the support assembly on which the gantry legs are secured, there is only a rotation of the truss with regard to the gantry. This change of geometry is accommodated by the ball joints connecting the pendulum leg assembly 210 to the transverse truss assembly 220, and the pin joint and translational adjustment providing relative twist between the fixed leg assembly 200 and the transverse truss assembly 220.

Figure 17C:
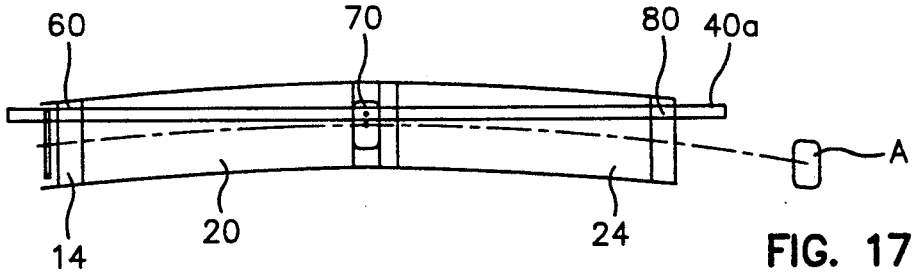
FIG. 17*c* is a diagrammatic plan view of another truss portion of the construction system of FIG. 17*a* in the pre-launch position.
Figure 17B:
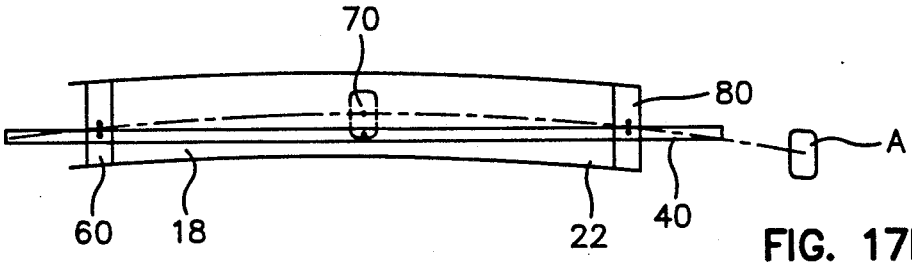
FIG. 17*b* is a diagrammatic plan view of one truss portion of the construction system of FIG. 17*a* in the pre-launch position.
Figure 17A:
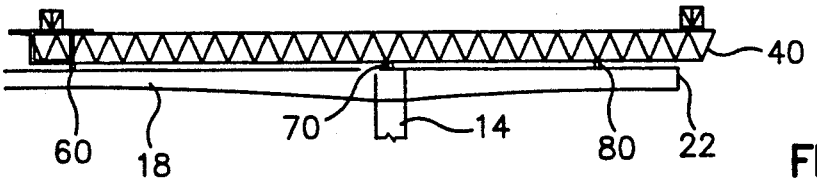
FIG. 17*a* is a diagrammatic side-elevation view of a construction system in accordance with the present invention in a pre-launch position.
Figure 18C:
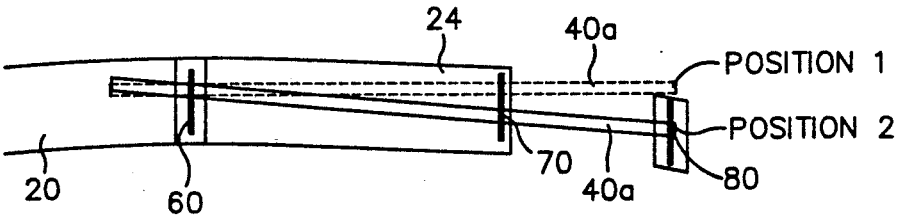
FIG. 18*c* is a diagrammatic plan view of another truss portion of the construction system of FIG. 18*b* following the first launching stage showing transverse positioning of the truss to accommodate bridge span curvature.
Figure 18B:
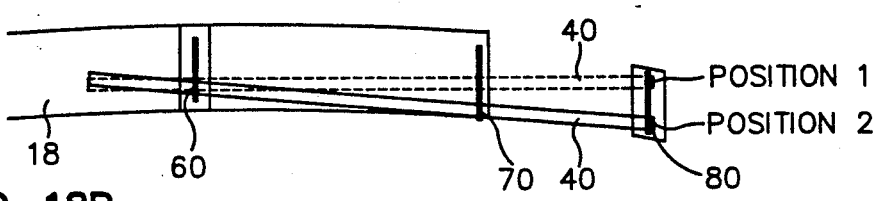
FIG. 18*b* is a diagrammatic plan view of one truss portion of the construction system of FIG. 18*b* following the first launching stage showing transverse positioning of the truss to accommodate bridge span curvature.
Figure 18A:
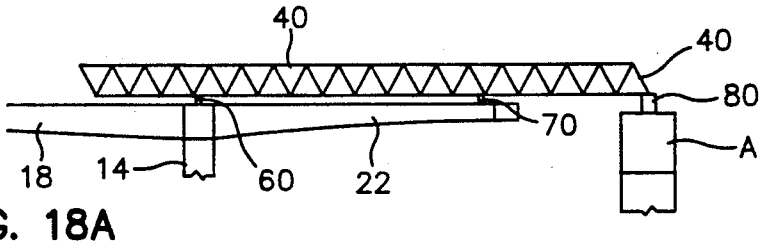
FIG. 18*a* is a diagrammatic side elevation view of the construction system of FIG. 17*a* following the first launching stage.
Figure 19C:
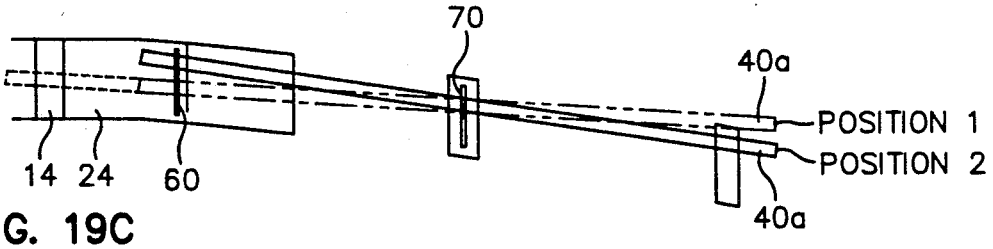
FIG. 19*c* is a diagrammatic plan view of another truss portion of the construction system of FIG. 17*b* following the second stage of launching showing additional transverse positioning of the truss to accommodate bridge span curvature.
Figure 19B:
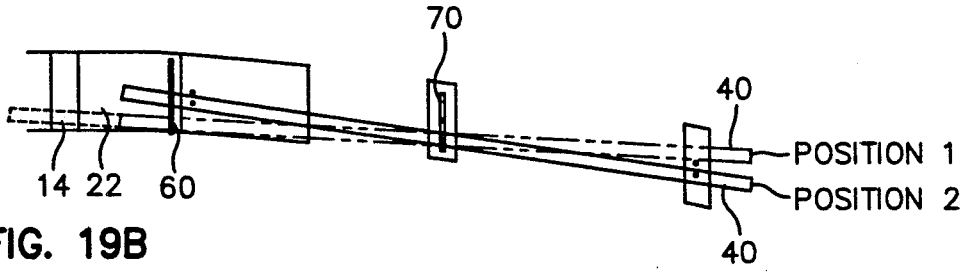
FIG. 19*b* is a diagrammatic plan view of one truss portion of the construction system of FIG. 17*b* following the second stage of launching showing additional transverse positioning of the truss to accommodate bridge span curvature.
Figure 19A:
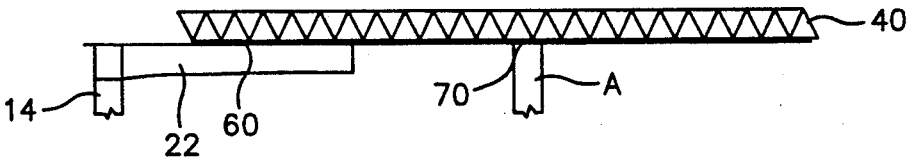
FIG. 19*a* is a diagrammatic side-elevation view of the construction system of FIG. 17*a* following the second launching stage.

Starting from the position shown in FIGS. 17*a*, 17*b* and 17*c*, the longitudinal trusses 40 and 40*a* are sequentially launched during the first launching stage to the truss position shown in FIGS. 18*a*, 18*b* and 18*c*. At that point, the rolling gantry crane is positioned at the support assembly 60 and the trusses 40 and 40*a* are additionally supported at mid-span by the support assembly 70 and at the forward ends thereof by the support assembly 80 located on pier "A," from which the next succeeding cantilever bridge section will be constructed. At this point, the trusses 40 and 40*a* occupy Position 1 shown in FIGS. 18*b* and 18*c*. The trusses 40 are then rotated about the support assembly 60 to Position 2, shown in FIGS. 18*b* and 18*c*. Rotation of the longitudinal trusses is accomplished by first rotating the truss associated with the pendulum leg assembly 210 of the rolling gantry 50. Before the second truss can be rotated, the jack assembly 590 on the fixed leg assembly 200 of the rolling gantry 50 is loosened. The second truss is then rotated. At that time, the leg 570 of the fixed leg assembly pivots about its connection 580. At this point, the rolling gantry transverse truss assembly 220 is still oriented approximately perpendicularly to the original orientation of the longitudinal trusses. To reorient the transverse truss assembly 220 perpendicularly with respect to the newly rotated longitudinal trusses, the pendulum leg assembly 210 or the fixed leg assembly 200, which ever is the further from the forward end of the longitudinal trusses, is moved longitudinal forwardly until laterally adjacent the opposing gantry leg assembly, with respect to the longitudinal truss ends. Stage two launching brings the longitudinal trusses 40 and 40*a* to Position 1 shown in FIGS. 19*a*, 19*b* and 19*c*. At that point, the rolling gantry crane 50 has been positioned at the support assembly 70 located on the next successive pier "A." The longitudinal trusses are then rotated about that point to Position 2 shown in FIGS. 19*b* and 19*c*. Other truss rotational sequences would also be possible in accordance with the teachings herein.

It is to be noted that the above described construction system easily accommodates many geometric variations between the bridge spans. Thus, when the bridge decks are at different elevations, the length of the pendulum leg assembly 210 can be varied to keep the gantry crane 50 horizontal or within a preferred transverse slope range, which may, for example be in a range of about +/− 5° from horizontal. Thus, an extension may be added to the pendulum leg as the elevation of one bridge span changes with regard to the other. When the bridges are not horizontally parallel, the pendulum leg will twist with respect to the transverse truss assembly to accommodate the horizontal change in distance between the bridge spans. Moreover, the pivotal connection between the pendulum leg assembly 210 and the transverse truss assembly 220 enables the pendulum leg assembly to pivot while enabling the transverse truss assembly to remain substantially transversely oriented. In the event that the bridge spans are not elevationally parallel, the gantry translation drive units 940 are synchronized by controlling the flow of hydraulic fluid in each motor thereof through the control of a digital processing unit (not shown) that evaluates and compares the relative travel of each gantry leg. The synchronization prevents one side from moving faster than the other where the vertical loads and longitudinal grades of the two longitudinal trusses are different. Any twisting that would otherwise be imparted to the gantry trusses due to the longitudinal trusses being non-elevationally parallel is alleviated by means of the pivotal connections between the transverse truss assembly and the pendulum leg assembly.

Accordingly, a construction system for fabricating precast segmental bridges has been shown and described. It is understood that the foregoing description and accompanying illustrations are merely exemplary and are no way intended to limit the scope of the invention, which is defined solely by the appended claims and their equivalents. Various changes and modifications to the preferred embodiments should be apparent to those skilled in the art. Such changes and modifications could be made without departing from the spirit and scope of the invention. Accordingly, it is intended that all such changes and modifications be covered by the appended claims and equivalents.

What is claimed is:

1. A bridge construction system comprising:

a first independent longitudinal truss positioned over a first bridge span;

a second independent longitudinal truss positioned over a second bridge span;

a gantry movably mounted on said trusses, said gantry having a first leg mounted to said first truss and a second leg mounted to said second truss, said gantry being drivable along said first and second trusses;

gantry drive means for controllably driving said gantry along said trusses;

a transverse trolley movably mounted on said gantry, said trolley being drivable along said gantry in a direction generally transverse to said longitudinal trusses, said trolley including winching means for lifting and carrying bridge components to be positioned along said bridge spans, and said trolley being selectively positionable over each of said bridge spans;

connection means for mounting said longitudinal trusses to bridge components disposed along said bridge spans; and said gantry including first compensation means for adapting said gantry to changes in longitudinal truss vertical spacing, second compensation means for adapting said gantry to changes in longitudinal truss grade and third compensation means for adapting said gantry to changes in longitudinal truss horizontal spacing.

2. The bridge construction system of claim 1 further including means for selectively launching said longitudinal trusses along successive portions of said bridge spans.

3. The bridge construction system of claim 2 wherein said launching means includes means for longitudinally securing said gantry to said longitudinal truss mounting means and longitudinally driving said trusses using said gantry drive means.

4. The bridge construction system of claim 1 wherein said longitudinal truss mounting means includes means for adjusting the transverse position of said trusses.

5. The bridge construction system of claim 4 wherein said longitudinal truss mounting means includes roller means for supporting said longitudinal trusses for rolling longitudinal movement.

6. The bridge construction system of claim 1 wherein said gantry first leg is fixedly mounted to said gantry and said gantry second leg is pivotally mounted to said gantry.

7. The bridge construction system of claim 6 wherein said gantry second leg is extendable to adjust the distance between said gantry and said second longitudinal truss.

8. The bridge construction system of claim 2 wherein said gantry legs include rollers that rollingly engage said longitudinal trusses.

9. The bridge construction system of claim 8 wherein said gantry legs further include launching frames pivotally mounted to said gantry legs, said launching frames being engageable with said longitudinal truss mounting means for longitudinally restraining said gantry during truss launching.

10. The bridge construction system of claim 1 wherein said gantry drive mans includes control means for selectively driving said gantry legs in response to changes in grade differential between said first and second longitudinal trusses.

11. A construction system for fabricating a multi-span bridge comprising:

longitudinal support means arranged in a span-wise direction over a pair of bridge spans having completed and uncompleted portions, said longitudinal support means including first and second longitudinal trusses;

mounting means for mounting said longitudinal support means to completed bridge portions; and bridge component transport means moveably mounted on said longitudinal support means for transporting bridge components in a span-wise direction, said transport means including means for lifting and transversely positioning bridge components for mounting to completed bridge portions along said pair of bridge spans, said transport means further including first compensation means for adapting said transport means to changes in longitudinal truss vertical spacing, second compensation means for adapting said transport means to changes in longitudinal truss grade and third compensation means for adapting said transport means to changes in longitudinal truss horizontal spacing.

12. The bridge construction system of claim 11 wherein said first and second longitudinal trusses include lower and upper roller rails extending over said pair of bridge spans.

13. The bridge construction system of claim 11 wherein said mounting means includes means for transversely positioning said longitudinal support means.

14. The bridge construction system of claim 11 wherein said mounting means includes roller means for rollably supporting said longitudinal support means.

15. The bridge construction system of claim 11 wherein said transport means includes means for rollably mounting said transport means to said longitudinal support means.

16. The bridge construction system of claim 11 wherein said transport means includes drive means for driving said transport means in a span-wise direction over said longitudinal support means.

17. The bridge construction system of claim 16 wherein said drive means includes differential means for differentially driving said transport means in response to elevation differences in said bridge spans.

18. The bridge construction system of claim 11 wherein said transport means includes an adjustable support frame structure.

19. The bridge construction system of claim 11 wehrein said first compensation means includes extendable means for maintaining said transport means in engagement with said longitudinal support means despite changes in longitudinal truss vertical spacing.

20. The bridge construction system of claim 11 wherein said second compensation means includes first pivotable joint means for supporting said transport means in engagement with said longitudinal support means despite changes in longitudinal truss grade.

21. The bridge construction system of claim 11 wherein said third compensation means includes second pivotable joint means for maintaining said transport means in engagement with said transport means despite changes in longitudinal truss horizontal spacing.

22. A method for constructing a multi-span pre-cast segmental bridge having a plurality of piers and at least two decks formed by joining a series of precast segments across the spans extending between successive piers, the method comprising the steps of:

arranging a first longitudinal truss over a first bridge span so as to be mounted at one truss end to the end of a first completed section of bridge or roadway, at one end of a first bridge span, and so as to be mounted on the next adjacent bridge pier at the other end of the first bridge span;

arranging a second longitudinal truss over a second bridge span so as to be mounted at one truss end to the end of a second completed section of bridge or roadway at one end of a second bridge span, and so as to be mounted on the next adjacent bridge pier at the other end of the second bridge span;

rollably mounting on said first and second longitudinal trusses a rolling gantry, said rolling gantry extending transversely between said longitudinal trusses and having a transversely moveable lifting trolley mounted thereon, said rolling gantry further including first compensation means for adapting said rolling gantry to changes in longitudinal truss vertical spacing, second compensation means for adapting said rolling gantry to changes in longitudinal truss grade and third compensation means for adapting said rolling gantry to changes in longitudinal truss horizontal spacing; and controllably driving said rolling gantry and said lifting trolley to fetch precast bridge segments from a source area and deliver said bridge segments for successive placement and attachment to said first and second bridge piers and bridge components previously attached thereto.

23. The method of claim 22 wherein said bridge segments are successively placed on the side of said bridge piers facing said first and second bridge spans, and on the opposing side of said bridge piers facing next successive bridge spans.

24. The method of claim 23 wherein following the completion of the first and second bridge spans and one half of next successive bridge spans, the longitudinal trusses are launched to extend over said next successive bridge spans.

25. The method of claim 24 wherein said longitudinal trusses are launched in a two-step sequence wherein said longitudinal trusses are first launched so that a first end thereof is supported over said first and second bridge piers while a second end thereof is supported over next successive bridge piers from said first and second bridge piers, said longitudinal trusses next being launched so that said second end of said longitudinal trusses extend to the middle of the bridge span extending beyond said next successive bridge piers, and so that said first end of said longitudinal trusses extends over the end of the completed portions of said bridge spans.

26. The method of claim 23 wherein temporary supports are placed under said longitudinal trusses as bridge components are added to next successive bridge span from said first and second bridge piers.

27. A bridge construction system comprising:

a first longitudinal truss positioned over a first bridge span;

a second longitudinal truss positioned over a second bridge span;

said longitudinal trusses including upper and lower roller bearing surfaces;

a plurality of truss support assemblies mounted to completed sections of said bridge spans, said truss support assemblies including a transverse support beam secured to said completed bridge span sections and a pair of roller assemblies mounted on said transverse support beam for rollably supporting said longitudinal trusses above said bridge spans;

a gantry movably mounted on said trusses;

said gantry having a pair of transverse trusses extending between said longitudinal trusses, said transverse trusses having an upper roller bearing surface thereon;

said gantry further including a lifting trolley rollably mounted on said transverse truss upper roller bearing surfaces, said lifting trolley including a winch and a spreader beam attached to said winch for picking up bridge segments and positioning them over a selected one of said bridge spans;

said gantry further including a fixed leg assembly and a pivotable leg assembly rollably mounted on said longitudinal truss upper bearing surfaces, said pivotable leg assembly being joined by ball joint connections to said transverse trusses; and a gantry drive mounted on said gantry legs for longitudinally translating said gantry along said longitudinal trusses.

28. The bridge construction system of claim 27 wherein said gantry legs have pivotally mounted thereon a launching frame connectable to said truss support assemblies to fixedly connect said gantry to said support assemblies to permit said longitudinal trusses to be driven by said gantry drive for launching said bridge construction system along said bridge spans.

29. The bridge construction system of claim 27 wherein said gantry leg assemblies are joined by ball joint connections to roller assemblies that are rollably mounted on said longitudinal truss upper bearing surfaces.

30. The bridge construction system of claim 29 wherein said roller assemblies include upper and lower rollers for rollably restraining said gantry against elevational movement.

31. The bridge construction system of claim 27 wherein said longitudinal truss upper bearing surface includes a longitudinally extending rack, and said gantry drive includes a pinion rollably engaging said rack.

32. The bridge construction system of claim 27 wherein said truss support roller assemblies include a plurality of truss support rollers providing elevational support for said longitudinal trusses.

33. The bridge construction system of claim 32 wherein said longitudinal trusses include upper and lower flanges and said truss support roller assemblies further include rollers extending between said upper and lower longitudinal truss flanges to restrain said longitudinal trusses against elevation displacement.

34. The bridge construction system of claim 33 wherein said truss support roller assemblies further include lateral roller rollably engaging the sides of said lower longitudinal truss flange to restraining said longitudinal trusses against transverse displacement.

35. The bridge construction system of claim 27 wherein said truss support assemblies include a transverse jack attached to said truss support roller assemblies for transverse displacement of said longitudinal trusses.

36. The bridge construction system of claim 27 wherein said lifting trolley includes a pair of roller assemblies rollably mounted on said transverse truss upper roller bearing surfaces.

37. The bridge construction system of claim 36 wherein said lifting trolley includes an operator's cab for controlling movement of said gantry, said trolley and said winch.

38. The bridge construction system of claim 27 wherein said gantry pivotable leg is extendable.

39. The bridge construction system of claim 27 wherein said fixed leg assembly includes a pair of upright supports, one of said supports having a pivot connection therein to accommodate gantry twist.

* * * * *